US005868220A

United States Patent [19]

Seale

[11] Patent Number: 5,868,220

[45] Date of Patent: Feb. 9, 1999

[54] SUPPORT LEGS

[75] Inventor: David Ian Seale, Breadsall, United Kingdom

[73] Assignee: Peritech Systems Public Limited Company, Derby, United Kingdom; a part interest

[21] Appl. No.: 843,117

[22] Filed: Apr. 18, 1997

Related U.S. Application Data

[63] Continuation of Ser. No. 360,795, Jan. 6, 1995, abandoned.

[30] Foreign Application Priority Data

Jul. 22, 1992 [GB] United Kingdom ..... 9215594

[51] Int. Cl.[6] ..... E04G 1/00

[52] U.S. Cl. ..... 182/222; 182/119

[58] Field of Search ..... 182/222, 119

[56] References Cited

U.S. PATENT DOCUMENTS

| | | | |
|---|---|---|---|
| 1,195,488 | 8/1916 | Marshall | 182/179 |
| 1,538,595 | 5/1925 | Schroeder | 182/179 |
| 2,299,823 | 10/1942 | Juculano et al. . | |
| 3,080,015 | 3/1963 | Van Devender . | |
| 3,175,642 | 3/1965 | Neeley . | |
| 3,547,227 | 12/1970 | Trevino . | |
| 3,564,803 | 2/1971 | Breeze | 182/178 |
| 3,850,264 | 11/1974 | Salinas | 182/179 X |
| 4,349,297 | 9/1982 | Misener | 182/222 X |
| 4,371,057 | 2/1983 | Blier . | |

FOREIGN PATENT DOCUMENTS

| | | | |
|---|---|---|---|
| 38846/50 | 8/1953 | Australia . | |
| 224837 | 10/1959 | Australia . | |
| 41267/58 | 10/1959 | Australia . | |
| 65059 | 12/1969 | Australia . | |
| 65059/69 | 12/1969 | Australia . | |
| 78787 | 4/1975 | Australia . | |
| 78787/75 | 4/1975 | Australia . | |
| 29840/71 | 8/1976 | Australia . | |
| 475408 | 8/1976 | Australia . | |
| 559494 | 12/1922 | France . | |
| 1419028 | 10/1965 | France . | |
| 152908 | 8/1953 | United Kingdom . | |
| 737637 | 12/1953 | United Kingdom . | |
| 2013764 | 8/1979 | United Kingdom | 182/222 |

*Primary Examiner*—Alvin Chin-Shue
*Attorney, Agent, or Firm*—Watts, Hoffmann, Fisher & Heinke Co., L.P.A.

[57] ABSTRACT

A support leg comprising an upstanding member and securing means for securing both an elongated member and a platform to the support leg.

32 Claims, 9 Drawing Sheets

SUPPORT LEGS

This application is a continuation of application Ser. No. 08/360,795, now abandoned.

This invention relates to support legs.

It is often necessary for plasterers and builders to use some form of platform to reach, for example, ceilings.

Various forms of platform are used, for example a trestle may be used upon which the workman can stand, or, in cases where trestles are not available, a make-shift platform may be constructed using, for example, milk crates and planks of wood. However, these constructions are unsatisfactory since, they are unstable and lacking in strength.

It is an object of the present invention to obviate and/or mitigate these disadvantages of the prior art.

According to one aspect of the invention there is provided a support leg comprising an upstanding member and securing means for securing an elongate member to the upstanding member, wherein when said elongate member is secured to the upstanding member, a platform member can be supported on the elongate member to define at least a part of a platform, the securing means being movable from a securing position to secure the elongate member to the upstanding member and a non-securing position where the elongate member can be removed from the upstanding member.

Preferably, the securing means comprises a projecting element adapted to engage said platform member when the securing means is in the securing position, thereby to hold the platform member on the elongate member. The projecting element may be elongate and may extend transversely from the upstanding member when the securing means is in the securing position.

Preferably, the securing means is adapted to receive the elongate member. The securing means may be in the form of a substantially U-shaped member adapted to receive an end portion of the elongate member. The U-shaped member may be curved to receive substantially cylindrical elongate members. Alternatively, the U-shaped member may be square or rectangular to receive elongate members having a substantially square or rectangular cross-section.

The U-shaped member may be provided with a threaded aperture to receive a bolt therein, to engage an elongate member received in the U-shaped member. The bolt may be of a configuration having a first threaded portion and a second portion extending transversely from the first threaded portion. Preferably, the second portion constitutes said projecting element. Preferably, the bolt is substantially L-shaped.

The invention is particularly suitable for use with elongate members in the form of bars which may be cylindrical or of rectangular cross-section. A suitable such bar is a length of scaffold tubing. Suitable further members may be in the form of planks.

At least one of said platform members may be provided with apertures in one edge thereof, whereby said projecting element can be received in one of said apertures in the planar member, to hold the platform member on the elongate member. Alternatively, at least one of said platform members may be provided with sleeves on the top face thereof, whereby said projecting element can be received in one of said sleeves, to hold the platform member on the elongate member.

Preferably, the U-shaped member may be attached at its ends to a substantially flat plate, preferably by welding. The substantially flat plate may be attached to the support means, preferably also by welding.

Preferably, one end thereof of the upstanding member attached to a ground engaging means. The securing means may be attached at the opposite end of the upstanding member.

Alternatively, the support leg may comprise first and second upstanding members, the first upstanding member being attached to the ground engaging means, and the second upstanding member being slidable within the first upstanding member, wherein the second upstanding member can be locked to the first upstanding member at any one of a desired number of positions along the length of the second upstanding member. Preferably, the first upstanding member is provided with a pair of apertures, the apertures of said pair being arranged opposite each other, whereby a holding member to hold the second upstanding member in said desired position can be received through the first upstanding member. The holding member may be in the form of a pin. The second upstanding member may be provided with a plurality of substantially vertically arranged pairs of apertures, the apertures of each pair being arranged opposite each other, to allow said pin to pass through the second upstanding member.

Thus, the second upstanding member can be raised or lowered as desired and selectively positioned such that a desired pair of apertures in the second upstanding member are in register with the apertures in the first member to enable the pin to extend through the first and second upstanding members to lock them to each other. The pin may be provided with a spring clip to secure the pin to the first upstanding member.

Preferably, the first upstanding member is of a rectangular cross-section and the second upstanding member is of a circular cross-section. The first upstanding member may be crimped at a top end region thereof to stabilise the second upstanding member.

Stabilising means may be provided to stabilise the support leg when in use. Preferably, the stabilising means comprises a further securing means attached to the upstanding member at a central portion thereof. Preferably, the stabilising means comprises first and second further securing means as described above. Said first and second further securing means may be arranged adjacent each other to receive a further elongate member therethrough.

According to another aspect of this invention, there is provided a platform comprising first and second pairs of supports legs as described in paragraphs 5 to 15 above, an elongate member extending between the upstanding members of each pair of support legs, said elongate member being secured to the support legs by said securing means, and at least one platform member extending between the elongate members.

The platform may comprise a plurality of said platform members arranged adjacent each other, each of said platform members being provided with cooperating formations which may be in the form of corresponding apertures and projections whereby the apertures of one of said platform members are adapted to cooperate with the projections of the adjacent platform member to hold said platform members together.

Each of said platform members may be provided with first and second apertures along one edge thereof, and first and second projections along the opposite edge thereof. Preferably, the first mentioned platform member is provided with projections adapted to be received in the apertures of the adjacent further member.

The platform member adapted to be arranged adjacent said support legs may be provided with sleeves on the top surface thereof to receive a part of the securing means.

The or each platform member may be in the form of an elongate planar member, for example, a plank.

According to a further aspect of this invention there is provided a support assembly for use in forming a platform on a staircase, said support assembly comprising a support leg as defined in paragraph 5 above wherein the upstanding member extends from a stair engaging member, having first and second ends, the first end being adapted to engage a stair, and said support assembly further including a further elongate member in the form of a support strut adapted to be adjustably secured to said engaging member to support said stair engaging member at a position spaced from said first end thereof.

The upstanding member may extend from said stair engaging member at a position intermediate said first and second ends, preferably towards the first end. The second end of the stair engaging member is preferably provided with second securing means to secure the support strut thereto. The second securing means may be adapted to receive the support strut.

The support assembly may be provided with third securing means, to secure to the upright member a third elongate member in the form of a stabilising member, whereby the stabilising member can extend from said support assembly to an adjacent similar support assembly. Preferably, two of said third securing means are provided which may be affixed to a plate.

An elongate bracing member may be secured to said upstanding member. Preferably, the bracing member is adapted to extend from said upstanding member to said stairs. The bracing member is preferably elongate and is conveniently secured to the upstanding member by fourth securing means which may be angled to permit the bracing member to extend from the upright member at an angle of between 10° and 80°, preferably between 30° and 60°. The support assembly may comprise first and second upstanding members as described in paragraph 13 above.

Said securing means and the second, third and fourth securing means described in the preceding four paragraphs may be adapted to receive the appropriate elongate member and is preferably of a U-shaped configuration which may round, substantially square or rectangular. The U-shaped member of each of the securing means may be provided with a threaded aperture to receive a bolt therein. The bolt may be substantially L-shaped and is preferably adapted to engage the elongate member.

An embodiment of the invention will now be described by way of example only with reference to the accompanying drawings, in which FIG. 1 is a side view of a support legs according to the invention;

Figure 8A:
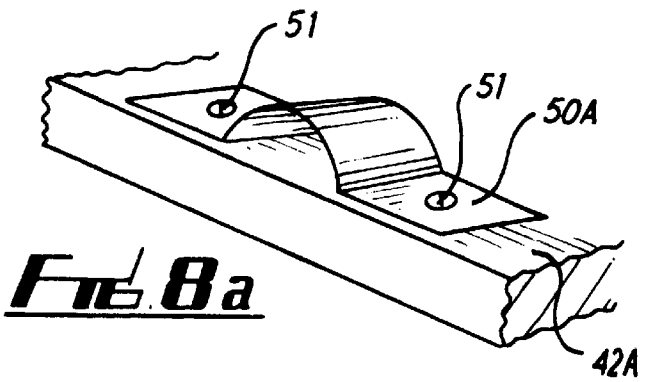
FIG. 8 is a view of an alternative platform to that shown in FIG. 7.
Figure 8:
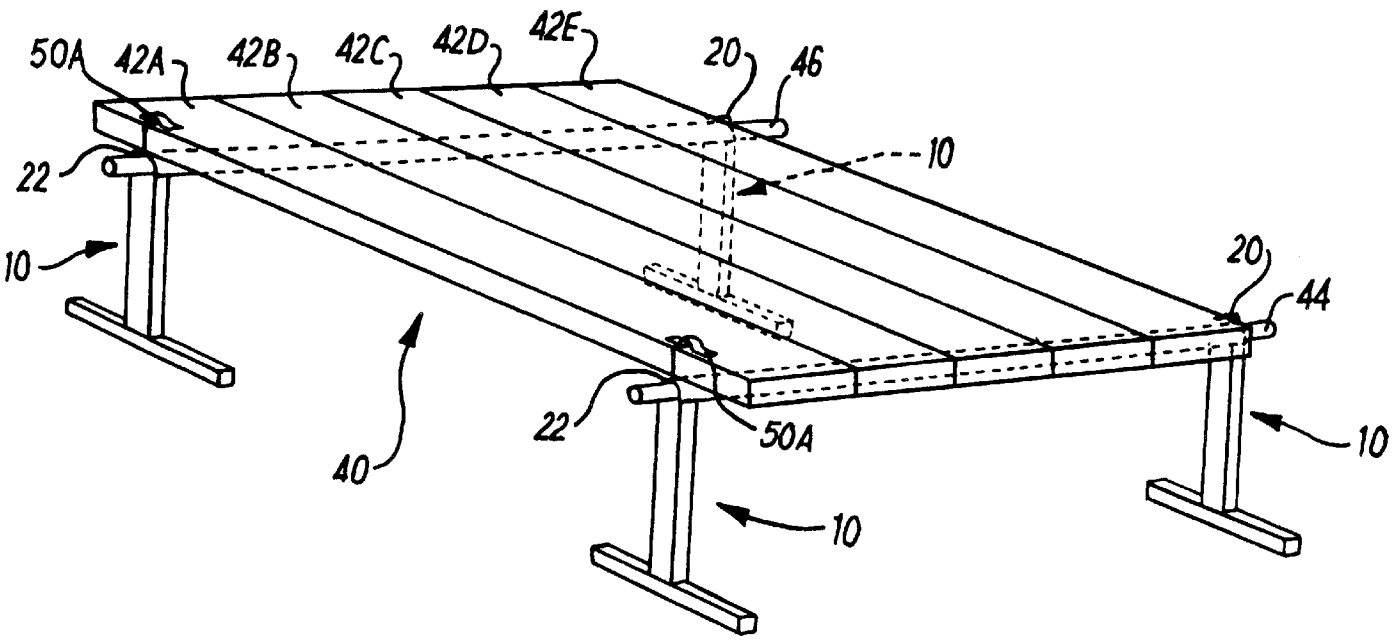

FIG. 8*a* is a close up of a sleeve used in the embodiment shown in FIG. 8.

Figure 1:
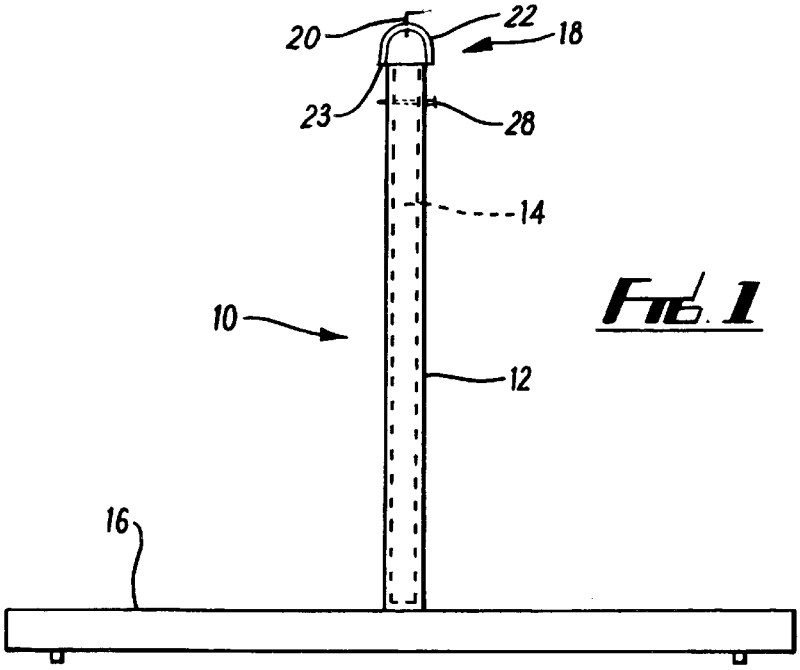
Figure 2:
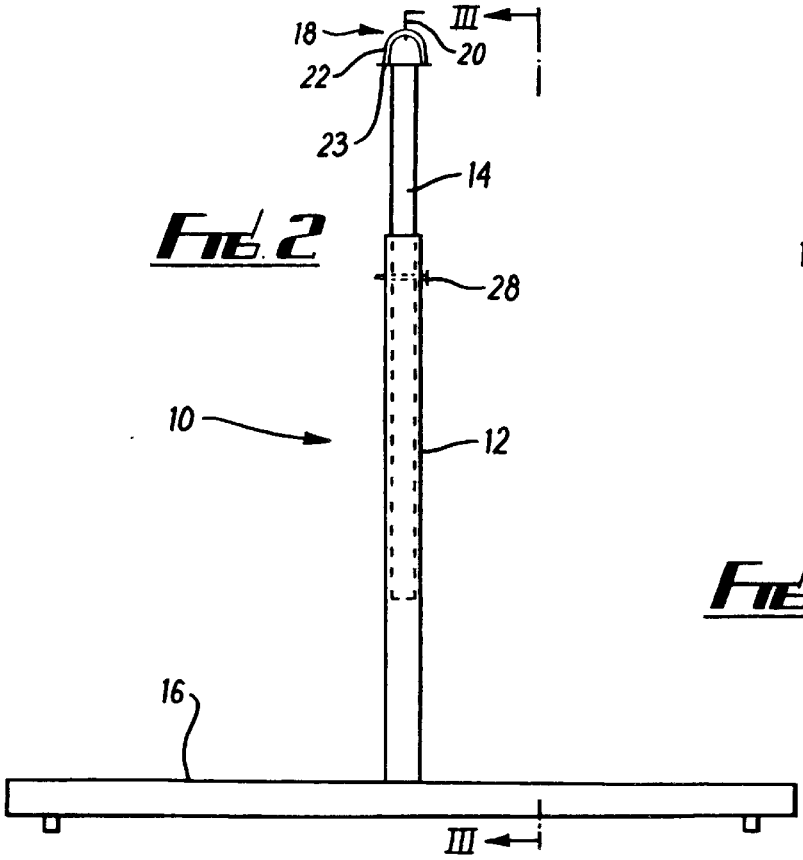
FIG. 2 is a side view of the support legs shown in FIG. 1 demonstrating that the height of the securing means can be adjusted.
Figure 9:
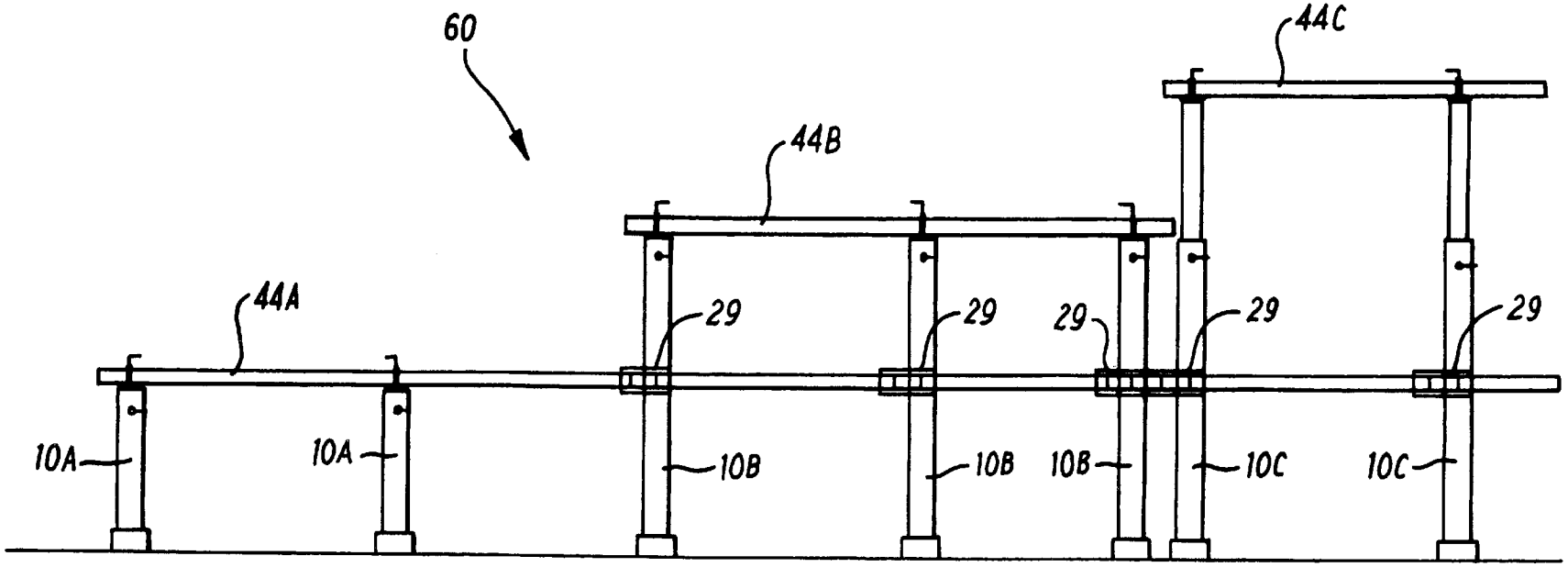
Figure 10:
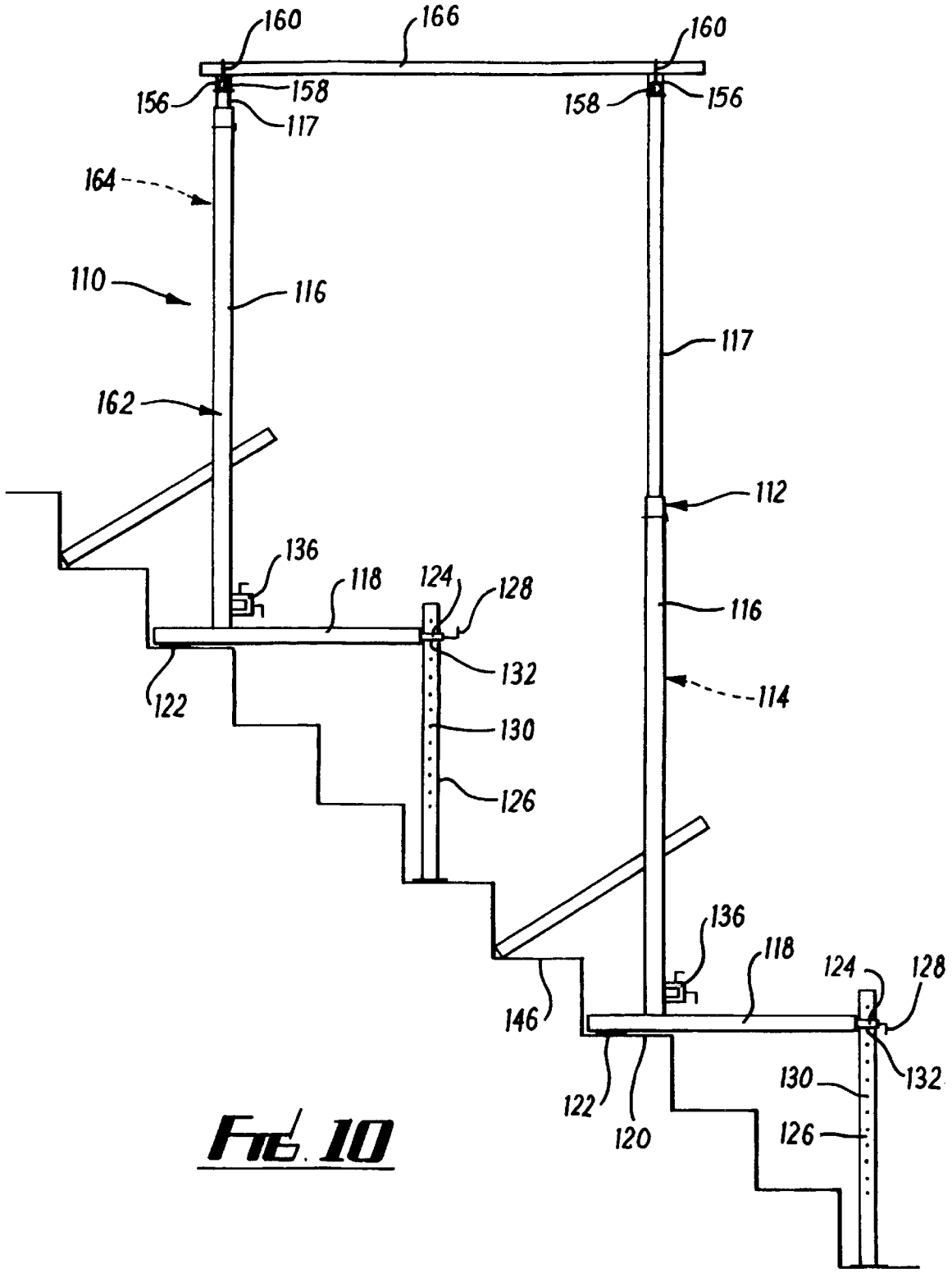
Figure 10A:
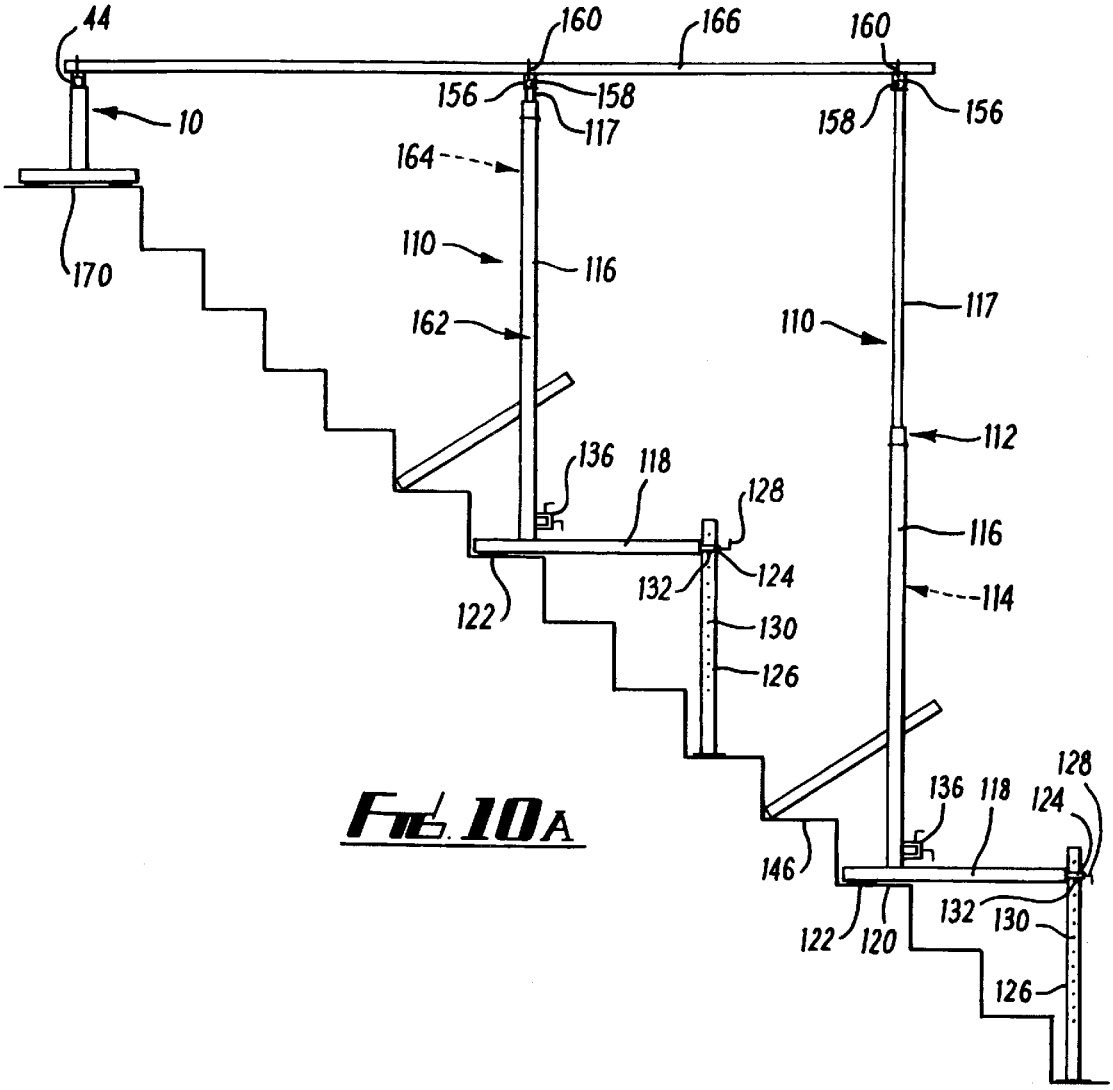
Figure 11:
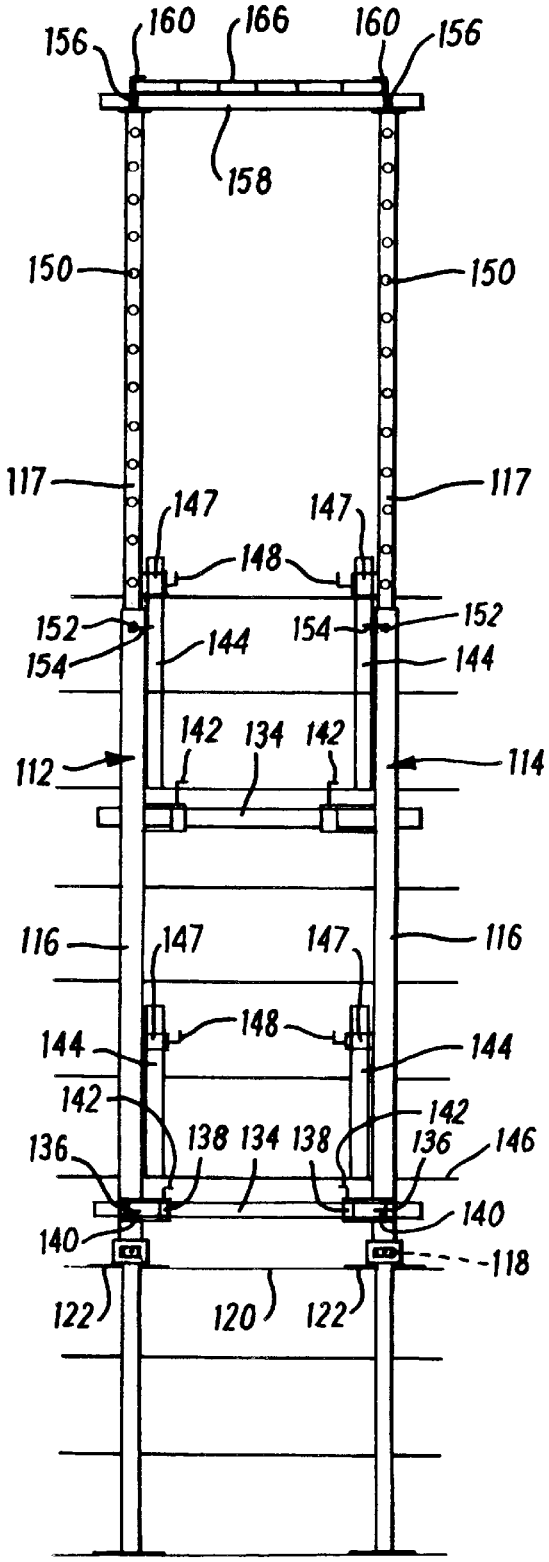

FIG. 9 is a side view of a system of supports shown in FIGS. 1 and 2 having a plurality of stages at different heights;

FIGS. 10 and 10A are a side view of an assembly comprising a plurality of support legs for use on a stair case; and FIG. 11 is a front view of the assembly shown in FIG. 10.

Figure 3:
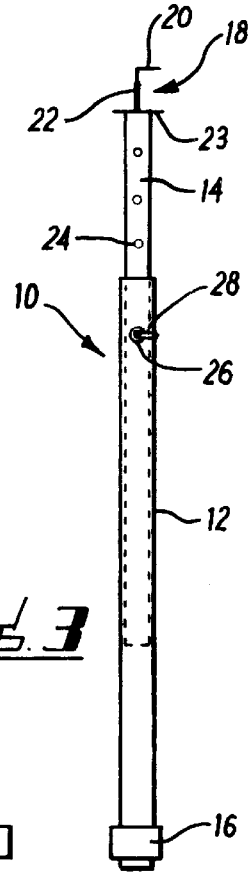
FIG. 3 is a view along the lines III—III in FIG. 2.

Referring to FIGS. 1 to 3, there is shown a support leg 10 comprising support means in the form of a first upstanding member 12 and a second upstanding member 14 slidably received within the first upstanding member 12. The support leg 10 also comprises ground engaging means in the form of a cross member 16. As shown in FIGS. 1 and 2 the support leg 10 is in the form of an inverted T. The height of the support leg 10, shown in FIG. 1 can be adjustable between, for example, 500 mm and 800 mm or 800 mm and 1400 mm but it will be appreciated that the support leg 10 can be of any other suitable height.

The support 10 also includes securing means 18 (see FIG. 6) which is in the form of an L-shaped bolt 20, and a U-shaped member 22. The U-shaped member 27 is welded to a flat plate 23 which, in turn, is welded to the top of the second upstanding member 14. In another embodiment, the second upstanding member may not be used, in which case the flat plate 23 is welded to the top of the first upstanding member 12. The height of such a support leg 10 can be, for example 500 mm or 800 mm, but it will be appreciated that the support leg can be of any other suitable height.

Figure 6:
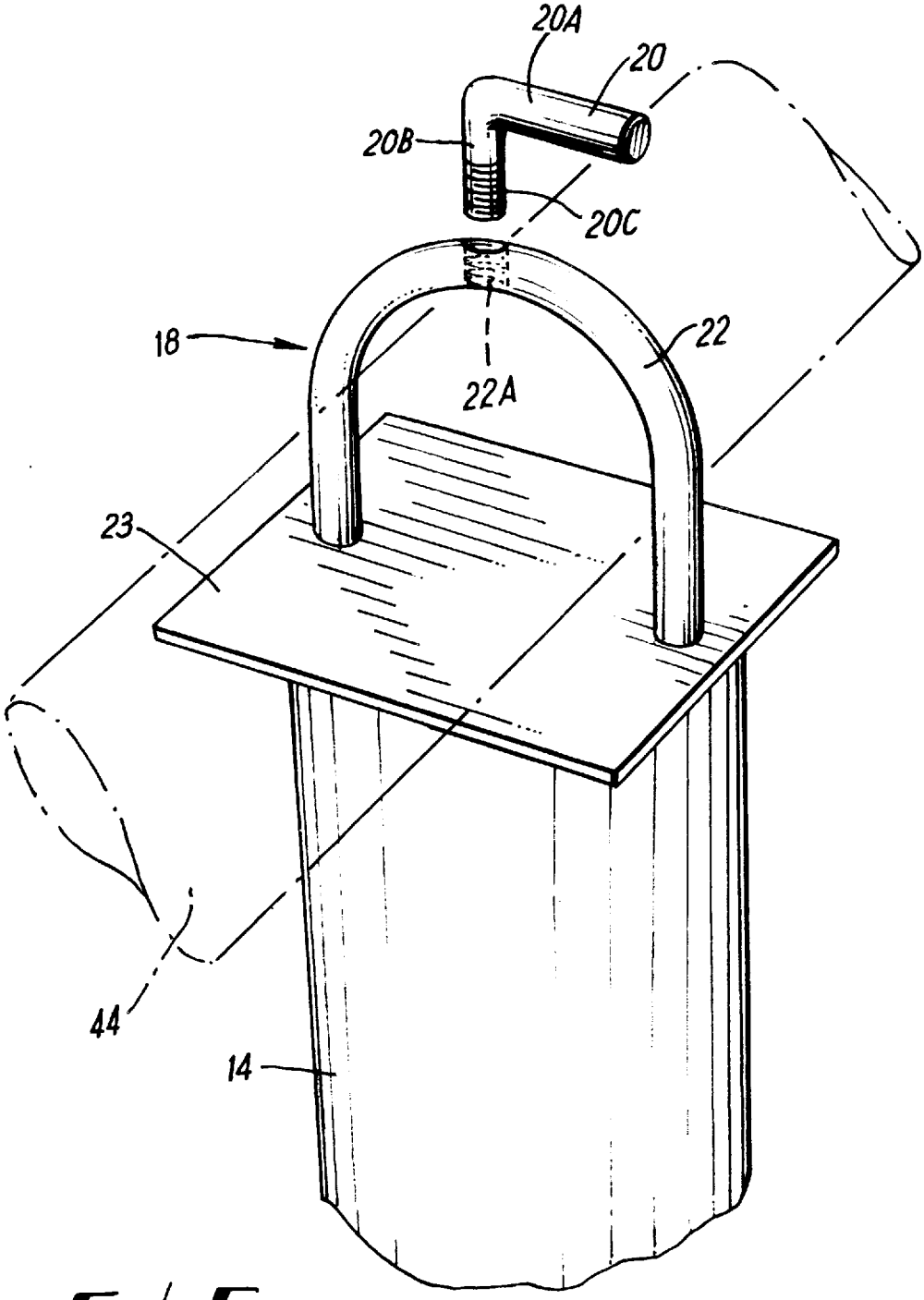
FIG. 6 is a close-up view of securing means of the invention.

As can be seen from FIG. 6, the L-shaped bolt 20 is provided with a first portion 20A and a second portion 20B. The end of the second portion 20B is threaded at 20C. The threaded end 20C of the bolt 20 can be received is a correspondingly threaded hole 22A in the U-shaped member 22. If desired, when the threaded end 20C of the bolt 20 is inserted into the threaded hole 22A for the first time, the leading thread of the bolt 20 can be deformed to prevent removal of the bolt 20 from the U-shaped member 22.

In use, a bar 44 extends through the U-shaped member 22. The bar 44 is secured to the securing means 18 by the threaded bolt 20 which is screwed into the hole 22A and bears against the bar 44. The bar 44 extends to the stabilising means 29 an adjacent support legs 110 and is secured thereto thereby securing both support legs 110 together to stabilise them.

The second upstanding member 14 is provided with a plurality of pairs of vertically arranged apertures 24. The apertures of each pair 24 are arranged opposite each other. (See FIG. 3) only one of each pair is shown in FIG. 3. The first upstanding member 12 is provided with a single pair of oppositely arranged apertures 26. When a desired one of the pairs of apertures 24 is arranged in alignment with a pair of apertures 26, a pin 28 can be passed through all four of the apertures 24, 26 to lock the first upstanding member 12 to the second upstanding member 14. Thus, different pairs of apertures 24 can be aligned with the apertures 26 so that the pin 28 can be used to lock the second upstanding member 14 at any one of a plurality of different heights, thereby making the height of the securing means 18 above the ground adjustable.

Figure 4:
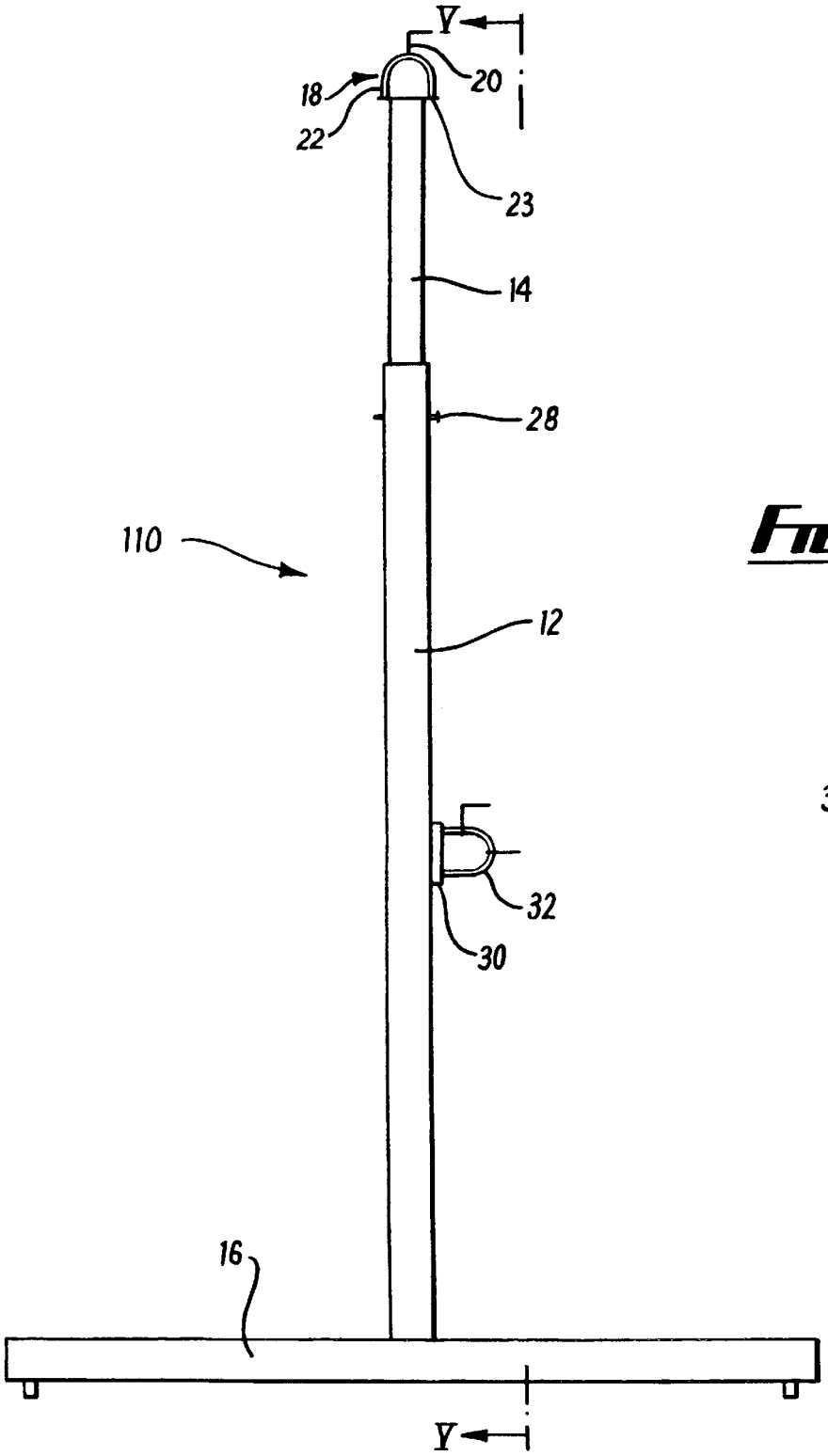
FIG. 4 is a view similar to FIG. 1 showing a further embodiment.
Figure 5:
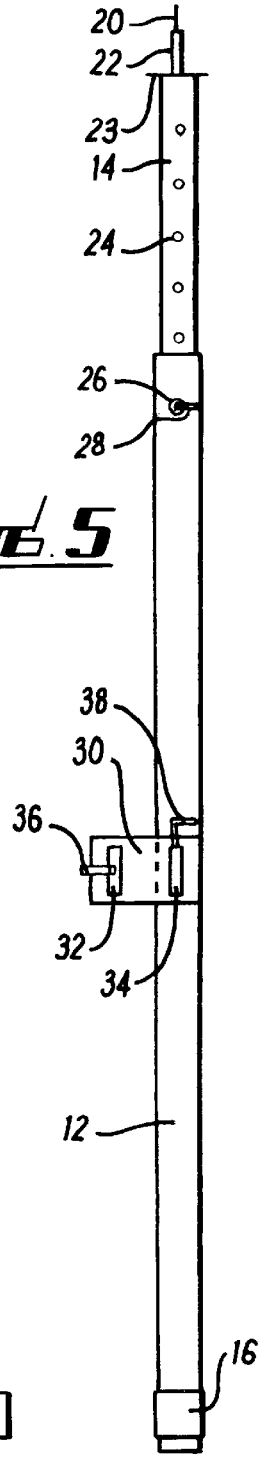
FIG. 5 is a view along the lines V—V in FIG. 3.

Referring to FIGS. 4 and 5, there is shown a second embodiment 110, which is generally the same as the embodiments shown in FIG. 1 to 3 except that the first upstanding member 12 in the embodiment shown in FIGS. 4 and 5 is longer than the first upstanding member 12 in the embodiments shown in FIG. 1 to 3. Also, the support leg 10 shown in FIGS. 4 and 5 is provided with stabilising means 29 in the form of a plate 30 and second and third U-shaped members 32, 34. The plate 30 is welded to a central region of the upstanding member 12. The second and third U-shaped members 32, 34 were welded to the plate 30 as shown.

The stabilising means 29 also comprises second and third bolts 36, 38 which are L-shaped and are threaded at one end. The bolts are adapted to be threadably received in the respective second and third U-shaped members 32, 34. As can be seen the U-shaped members 32, 34 end the bolts 36, 38 are similar to the U-shaped member 22 and the L-shaped bolt 20 and function in a similar manner.

Figure 7:
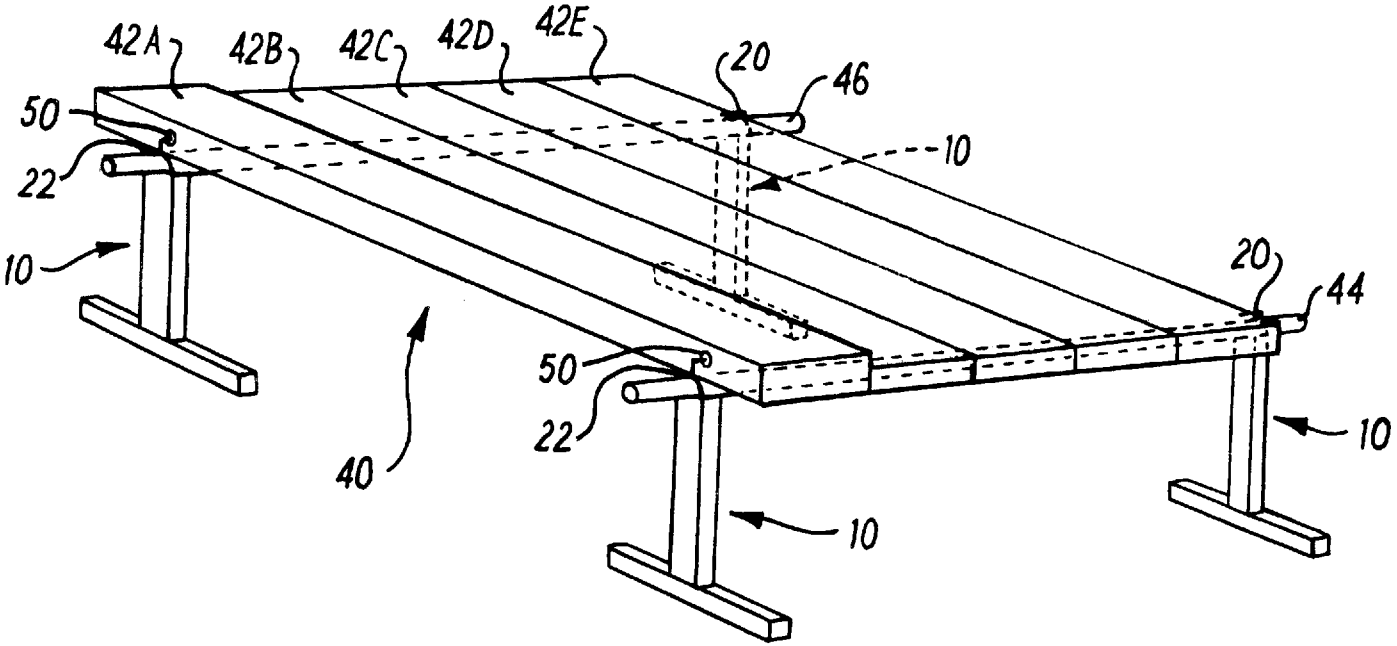
FIG. 7 is a perspective view of a platform incorporating a plurality of support leggs shown in FIG. 1.

Referring now to FIG. 7, there is shown a platform 40 which comprises a plurality of support legs 10 which are used to support a plurality of planks 42A to 42E. The first plank 42A is thicker than the other planks 42B–42E. The support legs 10 are arranged in the region of the respective four corners of the platform 40. A bar 44 extends between the pair of nearmost supports 10 as shown in FIG. 7 and a bar 46 extends between the pair of furthermost support legs 10. The bar 44 is secured to the supports 10 by means of the securing means 18. The ends of the bar 44, 46 extend through the respective U-shaped members 22 of the support legs 10. The L-shaped bolts 20 are threadably received in the U-shaped members 22 to engage the bars 44, 46 to secure the bars 44, 46 to the respective support legs 10.

The first plank 42A is then laid over the bars 44. As can be seen from FIG. 6, the leading edge of the first plank 42A is provided with a pair of apertures 50. These apertures 50 are each fitted with a ferrule which is used to secure the first plank 42A in place. The L-shaped bolts 20 are being tightened to secure the bars 44, 46 to the support legs 10, the first portion 20A of the L-shaped members 20 are arranged such that they point inwardly of the platform. In this way, the first plank 42A can be arranged on the bars 44, 46 such that the horizontal portion 20A of the bolts 20 are received in the ferrules fitted in the apertures holes 50. The remaining planks 42 are then arranged on the bars 44, 46 as shown in FIG. 7.

In order to hold the remaining planks 42B, 42E in place, each is provided with first and second apertures along one edge thereof and first and second projections along the opposite edge thereof. The projections on one plank can be received in the apertures of the adjacent plank thereby holding the two planks together. The final plank 42E to be arranged on the bars 44, 46 is held in place by the first portions 20A of the L-shaped bolt 20. When the final plank 42E is in place, the L-shaped bolts 20 are then tightened such that the first portions 20A of the bolts 20 are directed inwardly of the platform 40 and engage the top surface of the plank 42E. It will be appreciated that the user of the platform 40 can use any number of planks 42 as desired.

FIG. 8 and 8*a* show a modification to the platform shown in FIG. 7, in which the first plank 42A is of the same thickness as the other planks 42B–42E. Instead of a pair of apertures 50 provided in the leading edge of the first plank 42A is provided with a pair of sleeves 50A to receive the first portion 20A of the L-shaped bolts 20. One of the sleeves 50A is shown in more detail in FIG. 8*a*. Each sleeve 50A is attached to the plank 42A by suitable attaching means for example screws 51, or by gluing. Alternatively, the planks 42A–42E could be replaced by a single platform member of appropriate width.

FIG. 9 shows a system 60 comprising a plurality of support legs 10 arranged such that the bars 44, 46 are at different heights. Only the bars 44 are visible in FIG. 4, the bars 46 being directly behind the bars 44 and hidden from view. The system 60 can be used, for example, at an outdoor concert or show where seating is required. The left-hand support legs 10A as shown in FIG. 8 provide the lowermost seating. The bars 44A provide the support for planks. The middle support legs 10B provide seating at an intermediate height, with the bars 44B providing support for the planks. The right-hand support legs 10C as shown in FIG. 8 provide the highest seating with the bars 44C providing support for the planks. The bars 44A, 46A extend from the support legs 10A through the stabilising means 29 of the support legs 10B and 10C to stabilise the central and right hand portions of the system 60.

The support legs 10A on the left-hand side of FIG. 8 are those as shown in FIGS. 1 and 2 with the second upstanding member 14 in its lowermost position. The central support legs 10B are those as shown in FIGS. 4 and 5 with the second upstanding member 14 at its lowermost position. The support legs 10 at the right-hand side of FIG. 8 are the supports as shown in FIGS. 4 end 5 with the second upstanding member 14 at a raised position. The planks which would be arranged on top of the bars 42 have been omitted for clarity.

Various modifications may be made without departing from the scope of the invention. For example, the U-shaped members may have a square cross-section.

A further example of a modification is in the use of the support 10 as part of a bench which would, for example, be suitable for wall papering. In this modification a single board is arranged between the support legs 10 instead of the plurality of planks 42. Suitably, for use in wall papering, for example, the board can be 2½ feet wide and 5 feet in length. The board may be formed of plywood, for example ¾ inch thick. A length of timber which is the same length as the board is attached by gluing or screwing to one face of the board adjacent a first longer edge thereof. The length of timber can be, for example 2 inches thick and 5 inches wide. A strip of plywood, the same length as the board, can be attached to the same face of the board adjacent the opposite longer edge. The strip of plywood can be ¾ inch thick and 3 inches wide. Thus, there is provided on said face of the board a recess between the length of timber and the strip of plywood. The recess is approximately 22 inches wide and is wide enough to receive a roll of wall paper for applying paste thereto.

Two holes can be drilled in the first longer edge to receive ferrules which, in turn, receive the horizontal portion 20A of the L-shaped members 20. Alternatively as shown in FIG. 8, the first longer edge may be provided with sleeves attached to the top surface thereof to receive the horizontal portion 20A of the L-shaped members 20.

Referring to FIGS. 10, 10A and 11, there is shown a further modification in the form of a support assembly 110 to enable a platform to be set up on a staircase. The assembly 110 comprises at the front a pair of support legs 112, 114, and a further pair of support legs 162, 164 at the rear, each of which comprises a first upstanding member 116 and a second upstanding member 117 telescopically received in the first upstanding member. The first upstanding member 11 is connected to a transverse member 118 to engage a stair on the stair case. Each transverse member 118 comprises a plate 122 at one end thereof which provides a large surface for the transverse member to engage the stair 120.

As can be seen from the drawings, each upright member 116 extends from its respective transverse member 118 at a position offset from the centre thereof such that each upright member 116 extends from the transverse member 118 from a position above the stair engaged by the transverse member 118.

At the opposite end of each transverse member 116 to the plate 122, there is provided a generally U-shaped member 124, which may be of square or rounded cross-section. The U-shaped member 124 is adapted to receive a support strut 126. The U-shaped member 124 is the same as the U-shaped members described previously and is provided with a threaded aperture to receive a bolt 128 which can be L-shaped, as described previously. By screwing the bolt 128 into the threaded aperture in the U-shaped member 124, the bolt 128 engages the strut 126 to secure it to the transverse member 118, to provide support for the respective support legs 112, 114. The strut 126 may be provided with apertures 130 along its side, to receive a pin 132 to engage the underside of the U-shaped member 124 to provide additional support.

A stabilising member 134 extends between the support legs 112, 114 end is secured to each support leg by a pair of U-shaped members 136, 138 on the upstanding members 114 and a pair of bolts 140, 142. The U-shaped members 136, 138 are similar to the U-shaped members 32, 34 and function in the same way.

A bracing member 144 extends from each of the upstanding members 114 to the stair 146 above the stair 120 engaged by the transverse members (as shown) such that each bracing member 144 extends downwardly at an angle of between 30° and 60° to the respective upstanding member 114.

A fourth U-shaped member 147 is provided on each upstanding member 116 and is appropriately angled to receive the respective bracing member 144. A bolt 148 is provided to secure each bracing member 144 to its respective fourth U-shaped member 146.

Each second upstanding member 117 is provided with a plurality pairs of oppositely arranged longitudinally spaced apertures 150, as shown. A pair of oppositely arranged apertures 152 are provided towards the top of the first upstanding member 116. A pin 154 is provided which can be inserted through the pair of apertures 152 at the top of the first upstanding member 116 and through a desired one of the plurality of apertures 150 to hold the second upstanding member in position. Thus the height of the top of the second upstanding member can be adjusted.

A U-shaped member 156 is welded to the top of each of the second upstanding members 117 to receive a bar 158 extending between the two support legs 112, 114, in a similar manner to the bar 44 shown in FIGS. 6 and 7. The bar 158 can be secured to the support legs 112, 114 by L-shaped bolts 160 threadably received in apertures in the U-shaped members 156, in a similar function to that described previously.

A further pair of support legs 162, 164 are arranged at the 166 which is higher than the stair 120. The feature of the further pair of support legs 162, 164 are the same as the support legs 112, 114 and the same numerals designate the same members. The second upstanding members 117 of the further pair of support members is arranged so that the U-shaped members 156 are at the same height as the U-shaped members of the support legs 112, 114.

A plurality of planks 166 extend between the bar 158 of the first pair of support legs 112, 114 and the bar of the further pairs of support legs 162, 164. The L-shaped bolts engage in suitable sleeves affixed to the top of the first plank 164A to hold it in place.

In order to provide further support for the planks 166 a pair of support legs 10 (similar to the support legs 10 described above) can be disposed on the landing 170 at the top of the staircase. A further elongate member 44 extends between the support legs 10 upon which the planks 166 can rest. Thus, access to the platform on the staircase is provided via the landing 170. In cases where the distance between the support legs 10 and the support assembly 110 at the right hand side of FIG. 10A is not very great, the support assembly 110 in the middle of the support legs 10 end the right hand support assembly 110 is not needed.

In order to carry the support legs 10 a short length of tubing, of a similar section to the elongate members 44 can be used. As can be seen from FIGS. 8 and 8A there will be numerous occasions where a plurality of supports 10 are provided, for example four. In such cases, the short length of tube can be received in the U-shaped members 20, end the bolts 22 tightened against the short length of tubing. The bolts 22 can then be used as a handle to carry ell four support legs 10.

It is an advantage of the support legs described above that they can form platforms for a large number of different purposes. For example, the platforms can be used as a work bench, a trestle, a bed, a barbecue, shelving, for seating. It will be appreciated that this list of uses is not exhaustive and there are many more uses to which the support legs can be used.

I claim:

1. A platform comprising a support leg, an elongate member which can be secured to the support leg and a platform member which can be supported on the elongate member, and securing means for securing the elongate and platform members to the support leg, the securing means including a shaped member receiving the elongate member, the shaped member having a portion extending around the elongate member, the securing means further including a bolt and the shaped member also defining a threaded aperture to receive the bolt therein engaging the elongate member received by the shaped member, the bolt being movable from a securing position to secure the members to the support leg and a non-securing position where the members can be removed from the support leg, wherein the bolt comprises a first threaded portion and a second portion extending transversely from the first threaded portion, whereby the second portion constitutes a projecting element extending above the elongate member and engage said platform member when the bolt is in the securing position, thereby holding the platform member on the elongate member.

2. A platform according to claim 1 comprising a plurality of said support legs.

3. A platform according to claim 1 wherein the projecting element is elongate and extends transversely from the support leg when the securing means is in the securing position.

4. A platform according to claim 3 wherein the securing means includes a U-shaped member attached at its ends to a substantially flat plate, the substantially flat plate being attached to the support leg.

5. A platform according to claim 1 wherein the bolt is substantially L-shaped.

6. A platform according to claim 1 wherein said platform member defines apertures in one edge thereof, whereby said projecting element can be received in one of said apertures in the platform member, to hold the platform member on the elongate member.

7. A platform according to claim 1 wherein one end of the support leg is attached to a ground engaging means, the securing means being attached at the opposite end of the support leg.

8. A platform according to claim 1 wherein the support leg comprises first and second upstanding members, the first upstanding member being attached to a ground engaging means, and the second upstanding member being slidable within the first upstanding member, and wherein the second upstanding member can be locked to the first upstanding member at any one of a desired number of positions along the length of the second upstanding member.

9. A platform according to claim 8 wherein the first upstanding member defines a pair of apertures, the apertures of said pair being arranged opposite each other, whereby a holding member, to hold the second upstanding member in said desired position, can be received through said pair of apertures on the first upstanding member.

10. A platform according to claim 9 wherein the holding member is in the form a pin.

11. A platform according to claim 9 wherein the second upstanding member is provided with a plurality of substantially vertically arranged pairs of apertures, the apertures of each pair being arranged opposite each other, to allow said holding member to pass through a selected pair of said apertures on the second upstanding member.

12. A platform according to claim 8 wherein the first upstanding member is of a rectangular cross-section and the second upstanding member is of a circular cross-section.

13. A platform according to claim 12 wherein the first upstanding member is crimped at a top end region thereof to stabilize the second member.

14. A platform according to claim 1 wherein stabilizing means is provided to stabilize the support leg when in use.

15. A platform according to claim 14 wherein the stabilizing means comprises a second securing means attached to the support means at a central region thereof.

16. A platform according to claim 15 wherein the stabilizing means comprises two of said second securing means, both of said second securing means being arranged adjacent each other to receive a further elongate member therethrough.

17. A platform according to claim 1 comprising a plurality of said platform members arranged adjacent each other, each of said platform members being provided with cooperating formations, in the form of corresponding apertures and projections, whereby the apertures of one of said platform members are adapted to cooperate with the projections of the adjacent platform member to hold said platform members together.

18. A platform according to claim 17 wherein each of said platform members is provided with first and second apertures along one edge thereof, and first and second projections along the opposite edge thereof, whereby the projections of said platform member are adapted to be received in the apertures of the adjacent platform member.

19. A platform according to claim 1 for use on a staircase, wherein the support leg includes a stair engaging member from which the support leg extends, the stair engaging member having first and second ends, the first end being adapted to engage a stair.

20. A platform according to claim 19 wherein a support strut adapted to be adjustably secured to said stair engaging member to support said stair engaging member at a position spaced from said first end thereof.

21. A platform according to claim 19 wherein the support leg extends from said stair engaging member at a position intermediate said first and second ends.

22. A platform according to claim 21 wherein the support means extends from the stair engaging member at a position towards said first end.

23. A platform according to claim 19 wherein the second end of the stair engaging member is provided with second securing means to secure the support strut thereto, the second securing means being adapted to receive the support strut.

24. A platform according to claim 19 comprising a third securing means, to secure to the support leg a third elongate member in the form of a stabilizing member, whereby the stabilizing member can extend from said support assembly to an adjacent similar support assembly.

25. A platform according to claim 24 wherein two of said third securing means are attached to a plate.

26. A platform according to claim 19 wherein a bracing member is secured to said support leg, the bracing member being adapted to extend from said support leg to said stairs.

27. A platform according to claim 26 wherein the bracing member is elongate and is secured to the support means by fourth securing means which is angled to permit the bracing member to extend from the upright member at an angle of between 10° and 80°.

28. A platform according to claim 19 wherein said securing means and the second, third and fourth securing means are adapted to receive the appropriate elongate member and are of a U-shaped configuration.

29. A platform according to claim 28 wherein the U-shaped member of each securing means is provided with a threaded aperture to receive a bolt therein, the bolt being substantially L-shaped and being adapted to engage the elongate member.

30. A platform according to claim 19 wherein the support means comprises first and second upstanding members, the first upstanding member being attached to the stair engaging member, and the second upstanding member being slidable within the first upstanding member, wherein the second upstanding member can be locked to the first upstanding member at any one of a desired number of positions along the length of the second upstanding member.

31. A platform comprising:

a) first and second pairs of support legs, each of the legs including an upstanding member and securing means;

b) elongate members each extending between the upstanding members of an associated pair of support legs;

c) said elongate members being secured to the supports by said securing means;

d) at least one platform member extending between the elongate members;

e) the securing means of each leg being movable from a securing position securing its associated elongate member to the upstanding member of its leg, the securing means also having a non-securing position where the associated elongate member can be removed from the upstanding member; and, f) each said platform member arranged adjacent at least one of said support legs having sleeves on the top surface thereof receiving a part of the securing means therein.

32. A platform comprising a support leg, an elongate member which can be secured to the support leg and a platform member which can be supported on the elongate member, and securing means for securing the elongate and platform members to the support leg, the securing means being movable from a securing position to secure the members to the support leg and a non-securing position where the members can be removed from the support leg, wherein the securing means comprises a first threaded portion and a second portion extending transversely from the first threaded portion, whereby the second portion constitutes a projecting element extending above the elongate member and engage said platform member when the securing means is in the securing position, thereby holding the platform member on the elongate member and wherein said platform member is provided with sleeves on the top face thereof, whereby said projecting element is received in one of said sleeves, to hold the platform member on the elongate member.

* * * * *